US011123942B2

(12) United States Patent
van den Berg

(10) Patent No.: US 11,123,942 B2
(45) Date of Patent: Sep. 21, 2021

(54) METHOD FOR MAKING WINDOWED PACKAGING MATERIAL

(71) Applicant: JASA Group B.V., Alkmaar (NL)

(72) Inventor: Hendrik Jan van den Berg, Hoofddorp (NL)

(73) Assignee: JASA Group B.V., Alkmaar (NL)

( * ) Notice: Subject to any disclaimer, the term of this patent is extended or adjusted under 35 U.S.C. 154(b) by 191 days.

(21) Appl. No.: 16/492,952

(22) PCT Filed: Mar. 15, 2018

(86) PCT No.: PCT/NL2018/050165

§ 371 (c)(1),
(2) Date: Sep. 11, 2019

(87) PCT Pub. No.: WO2018/169401

PCT Pub. Date: Sep. 20, 2018

(65) Prior Publication Data

US 2020/0009820 A1 Jan. 9, 2020

(30) Foreign Application Priority Data

Mar. 15, 2017 (NL) ..... 2018516

(51) Int. Cl.

| | |
|---|---|
| ***B31B 70/82*** | (2017.01) |
| ***B31B 70/18*** | (2017.01) |
| ***B31B 70/83*** | (2017.01) |
| ***B31B 70/62*** | (2017.01) |
| ***B31B 70/86*** | (2017.01) |
| ***B65D 33/04*** | (2006.01) |

(Continued)

(52) U.S. Cl.

CPC ..... *B31B 70/826* (2017.08); *B31B 70/18* (2017.08); *B31B 70/62* (2017.08); *B31B 70/83* (2017.08); *B31B 70/864* (2017.08); *B65D 33/04* (2013.01); *B31B 2155/0014* (2017.08); *B31B 2160/106* (2017.08)

(58) Field of Classification Search

CPC . B31B 70/826; B31B 2160/106; B31B 70/18; B31B 70/83; B31B 70/864

USPC ..... 493/222

See application file for complete search history.

(56) References Cited

U.S. PATENT DOCUMENTS

| | | | |
|---|---|---|---|
| 2,428,266 | A | 9/1947 | Daniels |
| 4,164,170 | A | 8/1979 | Nordin |

(Continued)

*Primary Examiner* — Robert F Long
*Assistant Examiner* — Xavier A Madison
(74) *Attorney, Agent, or Firm* — N.V. Nederlandsch Octrooibureau; Catherine A. Shultz; Katelyn J. Bernier

(57) ABSTRACT

A method is disclosed for forming a windowed packaging material. According to the method a web of packaging material is cut in substantially the machine direction along a non-linear path. The cutting action provides two subwebs, each having protruding edge portions and recessed edge portions. The two subwebs are displaced relative to one another so that the protruding edge portions face one another. In this configuration opposing recessed edge portions form windows. The two subwebs are adhered to one another at the opposing protruding edge portions. The resulting windows may be covered with a material that is transparent and/or breathable. A strip of handle material may be applied spanning the respective windows.

13 Claims, 4 Drawing Sheets

(51) Int. Cl.
*B31B 155/00* (2017.01)
*B31B 160/10* (2017.01)

(56) References Cited

U.S. PATENT DOCUMENTS 4,368,051 A * 1/1983 Lehmacher ..... B31B 70/00
493/11
4,568,322 A * 2/1986 Piggott ..... B31B 70/00
493/196
4,702,731 A * 10/1987 Lambrecht ..... B31B 70/00
493/196
4,906,228 A * 3/1990 Reifenhauser ..... B65D 33/02
493/11
2009/0245697 A1* 10/2009 Yamazumi ..... B65D 33/12
383/7
2010/0024358 A1* 2/2010 Meseguer Huertas .....
B65D 33/065
53/128.1
2010/0068353 A1* 3/2010 Gorman ..... B65D 81/3469
426/107
2011/0245056 A1* 10/2011 Machamer ..... B31B 50/00
493/84
2014/0353307 A1* 12/2014 Pinkstone ..... B65D 5/2033
219/730

* cited by examiner

METHOD FOR MAKING WINDOWED PACKAGING MATERIAL

BACKGROUND OF THE INVENTION

1. Field of the Invention

The invention relates generally to windowed packaging material, and more particularly to windowed packaging material for use in a vertical form-fill-seal (VFFS) machine or a horizontal form-fill-seal (HFFS) machine.

2. Description of the Related Art

Flexible packaging materials are used extensively for packaging a variety of materials. Examples of flexible packaging materials include polymer film and paper. The flexible packaging material may be formed into a pouch or a bag, for example on a Vertical Form-Fill-Seal (VFFS) machine or on a Horizontal Form-Fill-Seal (HFFS) machine.

Flexible packaging materials are often opaque. For example, packaging paper is opaque by nature. Plastic film can be provided in a transparent or translucent form, but is often used in an opaque form so as to provide an appropriate background for printing text and/or images onto the material.

In many instances it is desirable to provide a package, such as a bag or a pouch, with one or more windows. The purpose of such windows may be showing the product that is inside the package, or to provide breathability to the package, or both.

The general approach to providing windows in flexible packaging material comprises removing from the packaging material a predetermined portion having the shape and dimensions of the desired window; and laminating the packaging material with a transparent material (such as a transparent polymer film) or with a breathable material (such as a net or a scrim) in the area where the predetermined portion of packaging material has been removed. Removing the predetermined portion of packaging material is done by die cutting or laser cutting, for example.

This approach to providing windows in a flexible packaging material suffers from two serious drawbacks. Firstly, it generates a significant amount of waste; and secondly, it creates a need for handling a waste stream. In particular the latter is a serious problem if the windows were to be formed on a VFFS or HFFS machine.

Thus, there is a particular need for a method for producing windowed packaging material that avoids the generation of a waste stream.

BRIEF SUMMARY OF THE INVENTION

The present invention addresses these problems by providing a method for producing windowed packaging material for use in the manufacture of windowed packaging, said method comprising the steps of:

a. providing a web of a packaging material, said web having a machine direction and a cross-machine direction;
b. cutting the web along a non-linear path in substantially the machine direction so as to form a first subweb and a second subweb, each having an edge having protruding portions and recessed portions;
c changing the machine direction position and the cross-machine direction position of the second subweb relative to the first subweb so that the protruding edge portions of the second subweb face protruding edge portions of the first subweb;
d. adhering the first subweb to the second subweb at their respective protruding edge portions to form a web of windowed packaging material.

The method may, for example, be carried out by a manufacturer of packaging material, and then shipped to an end user for converting the packaging material into packages.

Alternatively, the method may be carried out by an end user, for example on a modified VFFS or HFFS machine, or in a separate module positioned upstream of a VFFS or HFFS machine.

Another aspect of the invention comprises a windowed packaging material produced by the method of this invention.

Yet another aspect of the invention comprises a windowed package incorporating a packaging material produced by the method of this invention.

BRIEF DESCRIPTION OF THE DRAWINGS

The features and advantages of the invention will be appreciated upon reference to the following drawings, in which.

DETAILED DESCRIPTION OF THE INVENTION

Figure 1:
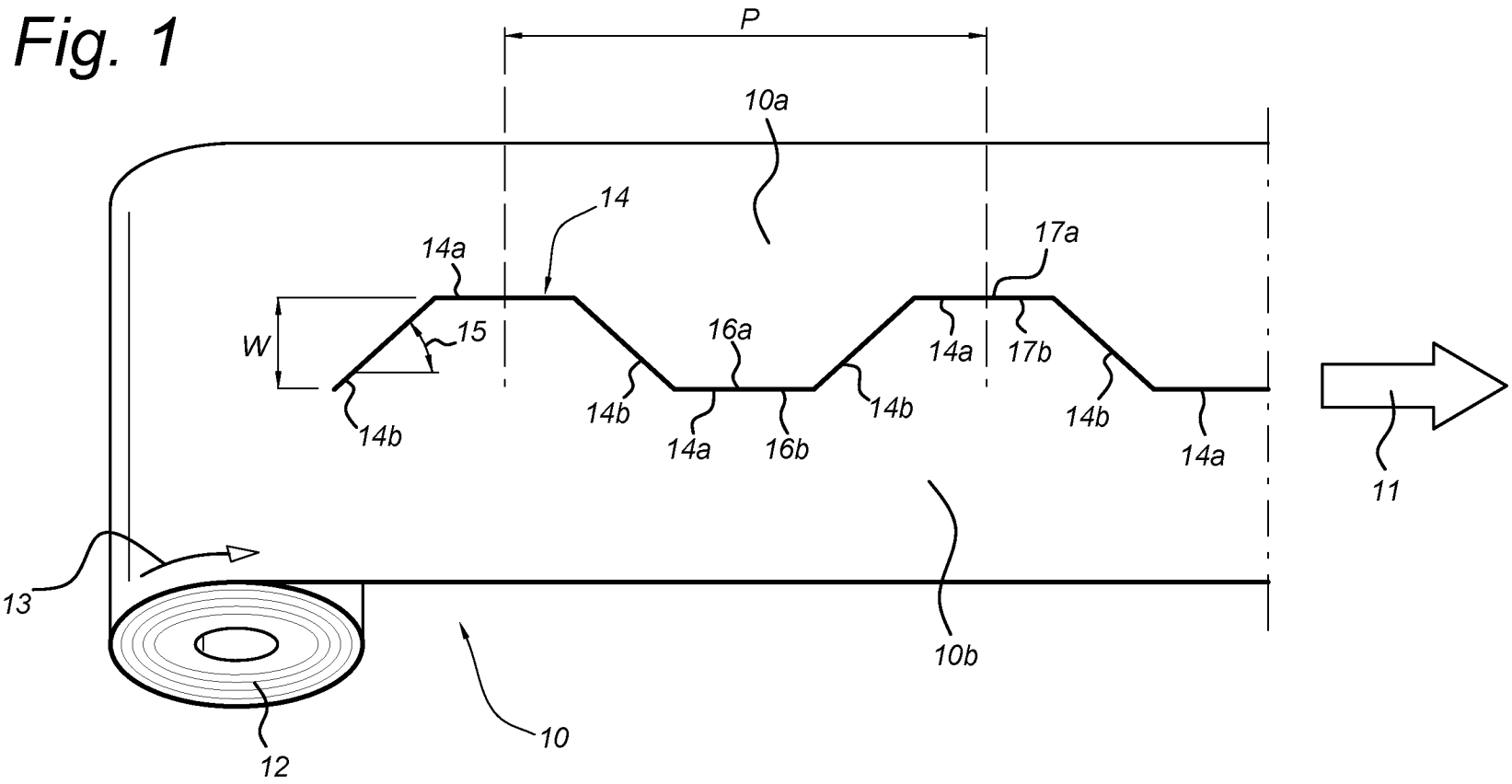
FIG. 1 is schematic representation of a web of flexible packaging material that has been cut along a non-linear path in substantially the machine direction of the web.

The following is a detailed description of the invention.

Definitions

The term "windowed packaging material" as used herein means a flexible packaging material having openings that are covered with a material that is transparent or translucent; or breathable; or both.

The term "machine direction" as used herein with reference to a web of material means the direction of the material as it travels through a packaging machine. In general packaging materials intended for use in a continuous machine have a longitudinal dimension that is many times greater than its width. The longitudinal dimension of such material is its machine direction. Its width is its cross-machine direction. These terms are well understood in the art.

The term "non-linear path" as used herein with reference to a line along which the web of packaging material is cut refers to line having portions parallel to the machine direction of the web and portions that are at an angle to the machine direction of the web, for example at an angle of from 30 degrees to 90 degrees. Cutting the web along such a non-linear path results in two subwebs, each having an edge with protruding edge portions and recessed edge portions.

The term "in substantially the machine direction" as used herein with reference to the non-linear path means that the non-linear path generally extends in the machine direction of the web. However, being non-linear, the path has distinct portions that deviate from the machine direction of the web.

In its broadest aspect the present invention relates to a method for producing windowed packaging material for use in the manufacture of windowed packaging, said method comprising the steps of:

a. providing a web of a packaging material, said web having a machine direction and a cross-machine direction;
b. cutting the web along a non-linear path in substantially the machine direction so as to form a first subweb and a second subweb, each having an edge having protruding portions and recessed portions;
c. changing the machine direction position and the cross-machine direction position of the second subweb relative to the first subweb so that the protruding edge portions of the second subweb face protruding edge portions of the first subweb;
d. adhering the first subweb to the second subweb at their respective protruding edge portions to form a web of windowed packaging material.

The main advantage of this method is that no waste stream is generated, so that the method does not require handling of a waste stream.

The method is generally suitable for providing windows in any flexible packaging material. Examples include paper; polyethylene (PE); polypropylene (PP); polyester (PE), for example polyethylene terephthalate (PET); and combinations and laminations thereof.

The subwebs formed in step c. may be adhered to one another by any suitable method, such as welding, or applying an adhesive, preferably a hot melt adhesive.

The two subwebs, when having been adhered to each other at their respective protruding edge portions, form a web of windowed packaging material. The material can be used as-is, provided the windows are smaller than the items being packaged in the packaging material.

In a preferred embodiment, the method comprises an additional step of applying a strip of material to the windowed packaging material in such a way that it covers the windows of the windowed packaging material. The strip of material may be transparent or translucent, and/or breathable.

In a further preferred embodiment a strip of handle material is applied across the windows. After a package is formed from the windowed packaging material the strip of handle material forms a handle spanning the window. Th handle material may be used by itself, or in combination with a strip of material that fully covers the window.

The strip of material may be applied to the windowed packaging material as a continuous sheet, in a swath that covers consecutive windows of the windowed packaging material. Alternatively, the strip of material may be applied as discrete individual patches, with each patch covering at least one window, and typically only one window. The strip material may be adhered to the windowed packaging material by applying an adhesive, for example.

Examples of suitable material for the strip include transparent polymer film, such as polyethylene film or polypropylene film; and breathable materials such as perforated polymer film, net materials, and scrim materials.

The step of cutting the web along a non-linear path may be carried out by any suitable method known in the art, for example using a die cutter or a laser cutter.

The method may comprise an additional step of forming a bag or pouch from the windowed packaging material. For example, the windowed packaging material may be produced by a manufacturer of packaging material; then shipped to a customer's location, where the material is used in a packaging machine, for example a VFFS machine or a HFFS machine.

In another embodiment the windowed packaging material is produced in a modified VFFS or HFFS machine, and used immediately for forming windowed packages, such as bags or pouches.

In a variant on the previous embodiment, the windowed packaging material is produced in a module that is placed upstream of a VFFS or HFFS machine, and fed into the VFFS or HFFS machine for forming packages.

Another aspect of the invention is a windowed packaging material produced by the method of the invention.

Yet another aspect of the invention is a package formed from a windowed packaging material produced by the method of the invention.

DESCRIPTION OF ILLUSTRATIVE EMBODIMENTS/EXAMPLES

The following is a description of certain embodiments of the invention, given by way of example only and with reference to the drawings. Referring to FIG. 1, a web of packaging material 10 is shown. Web 10 has a machine direction indicated by arrow 11. Web 10 is on a reel 12, from which it is unwound in the direction of arrow 13.

Web 10 is cut along non-linear path 14. Non-linear path 14 comprises portions 14*a* that are parallel to machine direction 11. In addition, non-linear path 14 comprises portions 14*b* that are at an angle to machine direction 11. The angle 15 is approximately 46 degrees. In general angle 15 can have any value between about 30 degrees and 90 degrees.

Cutting along non-linear path 14, which can be done by any suitable means, such as laser cutting or die cutting, results in the formation of subwebs 10*a* and 10*b*. The opposing edges of subwebs 10*a* and 10*b* have a geometry that is determined by the shape of non-linear path 14. The machine direction portions 14*a* form protruding and recessed edge portions in subwebs 10*a* and 10*b*. For example, subweb 10*a* has a protruding edge portion 16*a*, while subweb 10*b* has an opposing recessed edge portion 16*b*. Likewise, subweb 10*a* has a recessed edge portion 17*a*, and subweb 10*b* has an opposing protruding edge portion 17*b*.

As can be seen in FIG. 1, non-linear path 14 has a periodically repeating pattern, with periodicity P as indicated by the dotted lines. Similarly, non-linear path 14 occupies a width W.

Figure 2:
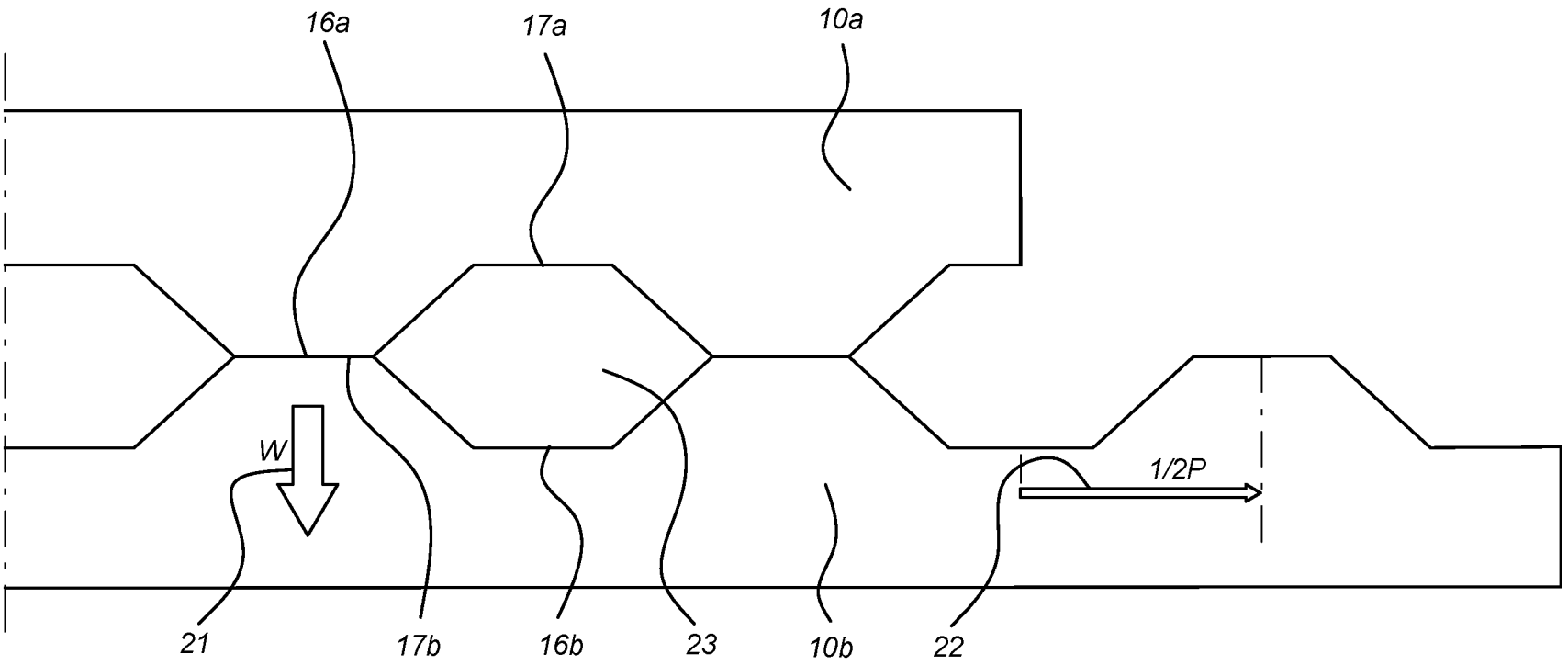
FIG. 2 is a schematic representation of two subwebs having their respective protruding edge portions in contact with each other.

FIG. 2 shows subwebs 10*a* and 10*b* after the two subwebs have been moved relative to each other. As compared to FIG. 1, in FIG. 2 subweb 10*b* has been moved in the cross-machine direction over distance W, as indicated by arrow 21. In addition, subweb 10*b* has been moved, relative to subweb 10*a*, in the machine direction over distance 0.5 P, as indicated by arrow 22. This step may be carried out in a continuous process by diverting or retarding one of the webs or may be carried out in an intermittent process e.g. in synchronisation with a form-fill-seal process or the like.

As a result of these two relative movements, protruding edge portion 16*a* of subweb 10*a* now faces, and touches, protruding edge portion 17*b* of subweb 10*b*. Recessed edge portion 17*a* of subweb 10*a* is now opposite to recessed edge portion 16*b* of subweb 10*b*, forming window 23.

In a next step the two subwebs are adhered to one another at their respective protruding edge portions, for example by welding or by applying adhesive. This step produces a web of packaging material having a pattern of windows 23 at equal distances from each other.

Figure 3:
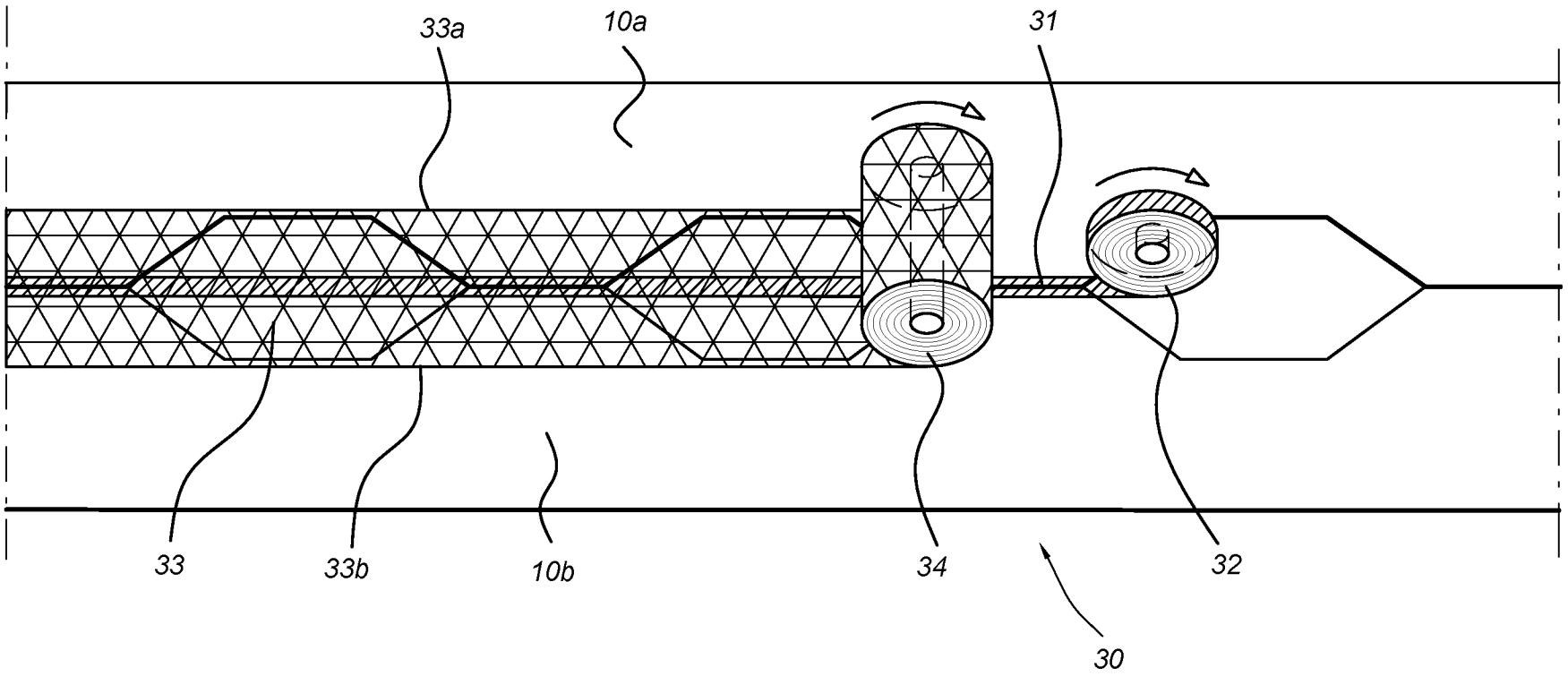
FIG. 3 is a schematic representation showing a web of scrim material being applied to a windowed web.

FIG. 3 shows a windowed web 30 to which tape 31 is applied from reel 32. Net material 33 is subsequently applied from a roll 34 and may be adhered to windowed web 30 by beads of adhesive (not shown) applied near edges 33*a* and 33*b*.

Figure 4:
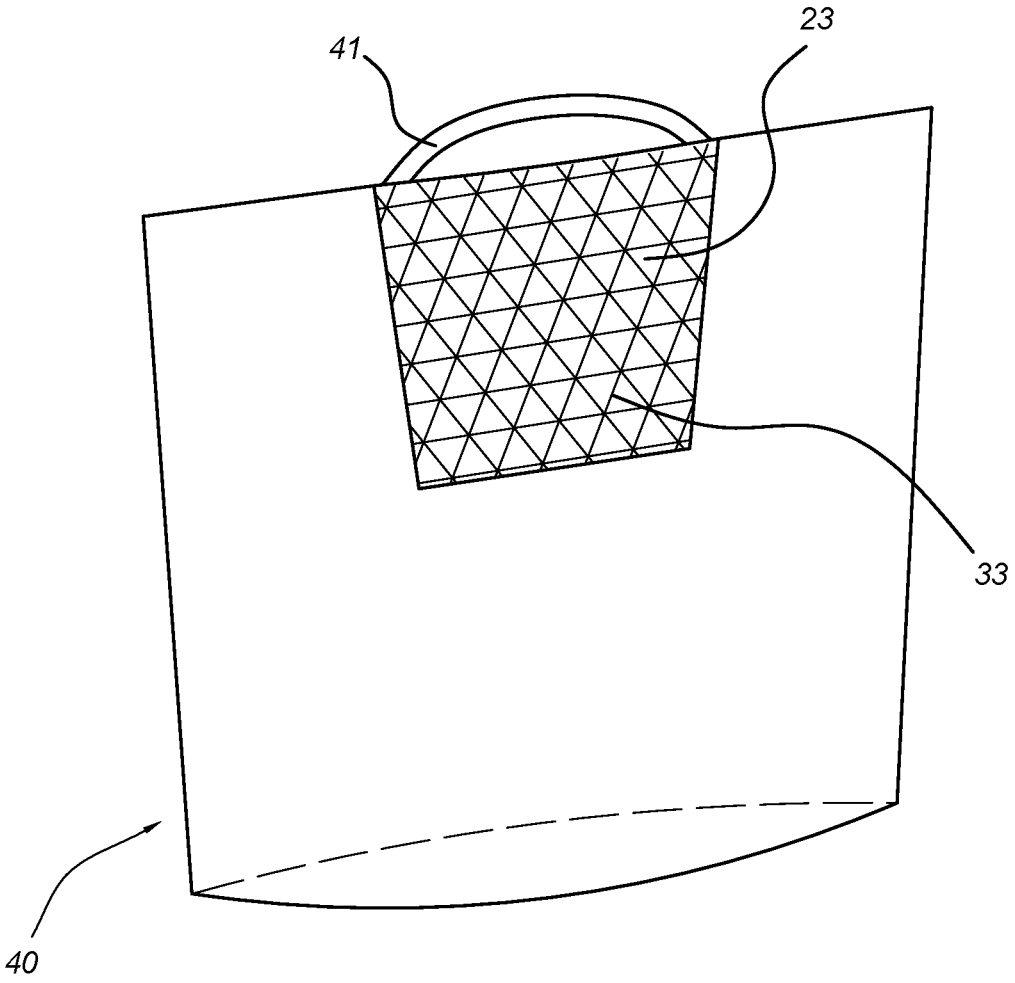
FIG. 4 shows a bag made with a windowed packaging material produced by the method of the present invention.

FIG. 4 shows a bag 40 made from the material of FIG. 3. In this case, the web 30 has been folded with the net material 33 inwards to form bag 40 with a window 23 covered with net material 33. Handle 41 is formed by a portion of tape 31 (see FIG. 3) exposed through window 23.

Thus, the invention has been described by reference to certain embodiments discussed above. It will be recognized that these embodiments are susceptible to various modifications and alternative forms well known to those of skill in the art. For example, the window may be modified by replacing the net material with a transparent film material.

Many modifications in addition to those described above may be made to the structures and techniques described herein without departing from the spirit and scope of the invention. Accordingly, although specific embodiments have been described, these are examples only and are not limiting upon the scope of the invention.

What is claimed is:

1. A method for producing windowed packaging material for use in the manufacture of windowed packaging, said method comprising the steps of:

a. providing a web of a packaging material, said web having a machine direction and a cross-machine direction;

b. cutting the web along a non-linear path in substantially the machine direction so as to form a first subweb and a second subweb, each having an edge having protruding portions and recessed portions;

c. changing the machine direction position and the cross-machine direction position of the second subweb relative to the first subweb so that the protruding edge portions of the second subweb face protruding edge portions of the first subweb;

d. adhering the first subweb to the second subweb at their respective protruding edge portions to form a web of windowed packaging material, wherein opposing recessed edge portions of the first subweb and the second subweb form windows in the windowed packaging material; and e. applying to the web of windowed packaging material a strip of material that is transparent, translucent and/or breathable in such a way that it covers the windows of the windowed packaging material.

2. The method of claim 1, further comprising a step of applying to the web of windowed packaging material a strip of handle material spanning at least one of the windows.

3. The method of claim 1, wherein the strip of material is a transparent polymer film.

4. The method of claim 1, wherein the strip of material is a net material.

5. The method of claim 1, wherein cutting step b. is carried out with a die cutter or a laser cutter.

6. The method of claim 1, comprising the further step of forming a bag from the windowed packaging material.

7. The method of claim 6, wherein the step of forming a bag is carried out in a vertical form-fill-seal (VFFS) machine or in a horizontal form-fill-seal (HFFS) machine.

8. The method of claim 1, wherein the packaging material provided in step a. is selected from paper, polyethylene (PE), polypropylene (PP), polyester, and combinations or laminates thereof.

9. The method of claim 1, wherein, in step d. the subwebs are adhered to one another by welding.

10. The method of claim 1, wherein, in step d. the subwebs are adhered to one another by applying an adhesive, preferably a hot melt adhesive.

11. The method of claim 1, wherein the strip is adhered to the windowed packaging material by applying an adhesive.

12. A windowed packaging material obtainable by claim 1, comprising a first subweb and a second subweb having respective protruding edge portions adhered together to form a web of windowed packaging material, wherein opposing recessed edge portions of the first subweb and the second subweb form windows in the windowed packaging material and a strip of transparent, translucent and/or breathable material covering the windows of the windowed packaging material.

13. A package formed from the windowed packaging material of claim 12.

* * * * *